United States Patent [19]

Blanchard, Jr.

[11] Patent Number: 4,561,793

[45] Date of Patent: Dec. 31, 1985

[54] AUTOMATIC WORK CORRECTING SYSTEM

[75] Inventor: Raymond A. Blanchard, Jr., Freeville, N.Y.

[73] Assignee: SCM Corporation, New York, N.Y.

[21] Appl. No.: 586,913

[22] Filed: Mar. 9, 1984

[51] Int. Cl.[4] ..... B41J 29/26

[52] U.S. Cl. ..... 400/697.1; 400/70

[58] Field of Search ..... 400/697, 697.1, 17, 400/69, 70

[56] References Cited

U.S. PATENT DOCUMENTS

| | | | |
|---|---|---|---|
| 3,780,846 | 12/1973 | Kolpek et al. | 400/63 |
| 3,823,389 | 7/1974 | Heitman et al. | 400/64 |
| 4,364,679 | 12/1983 | Longrod et al. | 400/212 |
| 4,395,149 | 7/1983 | Longrod | 400/215 |
| 4,396,305 | 8/1983 | Shattuck et al. | 400/208 |
| 4,408,915 | 10/1983 | Smith | 400/290 |
| 4,408,918 | 10/1983 | Smith | 400/697.1 |
| 4,436,192 | 3/1984 | Longrod | 192/43.1 |

*Primary Examiner*—William Pieprz

*Attorney, Agent, or Firm*—William E. Mear, III; Ernest F. Weinberger

[57] ABSTRACT

In an electronic typewriter, an automatic word correcting system includes a keyboard word erase function key for selectively causing automatic erasure of a word or a series of words. Operation of the word correcting system is based on electronic sensing of "space" or non-print functions and successive recall of consecutively printed characters stored in a print line memory of a control circuit in the typewriter. To erase a previously typed word after other words have been typed, the operator aligns (backspaces) a carrier print point at any print line position occupied by the word. Then a single one touch (depress/release) actuation of the Word Erase Key operates an electronic word erase control that causes the carrier to automatically move to the right to find and then stop the carrier when the subsequent "space" function is electronically sensed in memory. The typewriter is then caused to be automatically operated in word correction mode to progressively move leftwardly erasing consecutive printed characters of the unwanted word in reverse order. The erasing action is caused to automatically stop when the next left "space" or non-print function is electronically sensed in memory and the typewriter may then be operated in normal fashion for character printing in the erased positions.

11 Claims, 7 Drawing Figures

AUTOMATIC WORK CORRECTING SYSTEM

BACKGROUND

1. Field of Invention

This invention relates to electronic typewriters of the kind having self-correcting capability. More particularly, it relates to such a correcting typewriter improved to include a word correcting system for enabling the operator to erase an entire word or a series of words automatically without operator visual concern during correction mode.

2. Description of Prior Art

Heretofore most typewriters contained a keyboard and a mechanical typing mechanism (typebars, ball, or printwheel) which operated in response to actuation of finger keys on the keyboard. Complex mechanical linkages were provided for coupling motion from the finger keys to the typing mechanism in order to cause the characters selected at the keyboard to be typed. The overall complexity of these linkages rendered them slow and awkward to use and contributed to many other disadvantages.

Recently, so called "electronic typewriters" have appeared which contain a control circuit for operating typewriter functions responsive to selected keyboard keys. The output of the keyboard consists of electronic signals which are processed in an electronic data processing system within the typewriter to generate suitable control signals for driving solenoids and step—or servo—motors to cause, e.g., the typing mechanism to print selected characters. One advantage of electronic typewriters over their mechanical counterparts is the elimination of the complex mechanical linkages between the keyboard and the typing mechanism. Another important advantage is the electronic typewriter's ability to "remember" the last plurality of characters typed so that if an error has been made, the typist can backspace to the location of the error, and, responsive to selection of a keyboard correct key, automatically have the erroneous character recalled from the electronic memory and retyped over a correction ribbon so as to erase the erroneous character. Deep selection of the correct key normally effects repeat mode for causing several erroneous characters to be erased. One such automatic erasing electronic typewriter is shown in U.S. Pat. No. 3,870,846 to Kolpek et al, granted Dec. 23, 1973.

While prior error-correcting electronic typewriters have been able to work satisfactorily, their capabilities were limited in that error correction is accomplished on a character-for-character basis. That is to say, individual erase signals are required for each character to be erased. When an entire word or series of words are found in need of erasure, the typist is required to maintain a repetitive character correcting mode by holding a correction key depressed until the last erroneous character is erased. In the repetitive correcting mode the machine backspaces and erases in rapid order so that the typist must be visually alert to avoid overshooting or undershooting the last erroneous character.

Another problem found in prior error-correcting electronic typewriters is that when an error is discovered after one or more additional words have been typed, the typist is required to backspace the printer to the precise location of the erroneous character or the last character of an unwanted word. This task also requires visual concentration that slows typing and may result in the wrong character being erased if the printer is not precisely aligned for making the desired correction.

The above-mentioned U.S. Pat. No. 3,870,846 provides word and line correcting capability, however, such is accomplished without keystroke efficiency. In order to erase a word in the U.S. Pat. No. 3,870,846, the erase key is required to be displaced to a deep level for closing both a primary and a secondary erase key switch. The typist is required to maintain deep actuation of the erase key when more than one word is to be erased. In addition to employing a plurality of erase switches that contributes to the machine's overall complexity, the problem of accurately aligning the printer to the erroneous character is present in U.S. Pat. No. 3,870,846.

SUMMARY OF THE INVENTION

To overcome the problems and limitations of prior error-correcting electronic typewriters, a truly automatic word correcting system is disclosed that enables the typist to erase an entire word or a series of words without visual concern during a word correction mode and without requiring the printer to be precisely located at the last character of the unwanted word to begin correction mode. According to the invention a new Word Erase Key is included in the keyboard of the presently disclosed electronic typewriter. For reference sake and for test purposes the disclosed word correcting system including the Word Erase Key has been incorporated to operate in an error-correcting typewriter known as Ultrasonic III Messenger being manufactured in Cortland, NY by the Smith-Corona Division of SCM Corporation.

In order to erase a word, the typist merely actuates the Word Erase Key in a manner accustom to character key selection and through the illustrated flow charts implemented by the disclosed electronic circuitry, the word correction mode of the typewriter is operated to erase the word. The word correction mode is automatically caused to stop in response to electronic sensing of the "space" vacancy preceding the just erased word. If the unwanted word is discovered after one or more other words have been typed, the typist merely backspaces the carrier to any one of the horizontal print line positions occupied by the unwanted word and actuates the Word Erase Key. Thus precise backspacing to the exact position of the erroneous character as in prior correction systems is avoided. After the Word Erase Key is actuated the carrier is caused to automatically move rightwardly to the end of the unwanted word. The typewriter is then automatically operated in word correction mode to erase all characters of the unwanted word in reverse order.

In order to erase a series of unwanted words, the typist sequentially actuates the Word Erase Key a number of times equivalent to the total number of words to be erased. The typewriter is automatically operated in word correction mode until the "space" function preceding the first unwanted word of the series (last to be erased) is electronically sensed in print line memory. Effectively, multiple selection of the Word Erase Key operates the carrier for moving through "space" or non-print positions in memory until an equivalent number of words have been erased.

A number of different word-correcting situations are set forth hereinbelow for which the disclosed automatic word correcting system is suited to facilitate the task of correcting word errors.

OBJECTS OF THE INVENTION

Accordingly several objects of the present invention are to provide an electronic correcting typewriter with an improved automatic correction feature, to provide an electronic correcting typewriter with a new word correcting system including a keyboard function key for enabling the typist to erase an entire word or a series of words automatically without visual concern and to provide an improved correction system wherein the typist need not precisely relocate the typewriter print point at the last character of an unwanted word in order to erase that word, rather, the print point may be backspaced to any horizontal line position occupied by the unwanted word to effect automatic erasure of that word. Further objects and advantages will become apparent from a consideration of the ensuring description and the accompanying drawing.

CROSS REFERENCE TO RELATED PATENTS

The following patent cases describe various other inventions which can be used concurrently with the present invention; these patent cases disclose various details and other aspects relating to the operation and construction of the typewriter discussed herein:

I. U.S. Pat. No. 4,408,915, issued on Oct. 11, 1983, entitled Reverse Tab Control For Typewriters;

II. U.S. Pat. No. 4,408,918, issued on Oct. 11, 1983, entitled Halfspace Control System For Electronic Typewriter With Correction Register;

The two above-mentioned cases are of Michael H. Smith,

III. U.S. Pat. No. 4,364,679, issued on Dec. 21, 1982, entitled Cartridge Ribbon Lift Apparatus, of Scott J. Longrod and Francis R. Oakley;

IV. U.S. Pat. No. 4,396,305, issued on Aug. 2, 1983, entitled Ribbon Cartridge Handling Apparatus, of Richard E. Shattuck and Francis R. Oakley;

V. U.S. Pat. No. 4,395,149, issued on July 26, 1983, entitled Ribbon Drive Mechanism; and VI. U.S. Pat. No. 4,436,192, issued on Mar. 13, 1984, entitled Ribbon Drive Clutch.

The two above-mentioned cases (V, and VI) are of Scott J. Longrod.

All of the above-mentioned cases have the same assignee as the present invention.

DETAILED DESCRIPTION OF THE INVENTION

Figure 1:
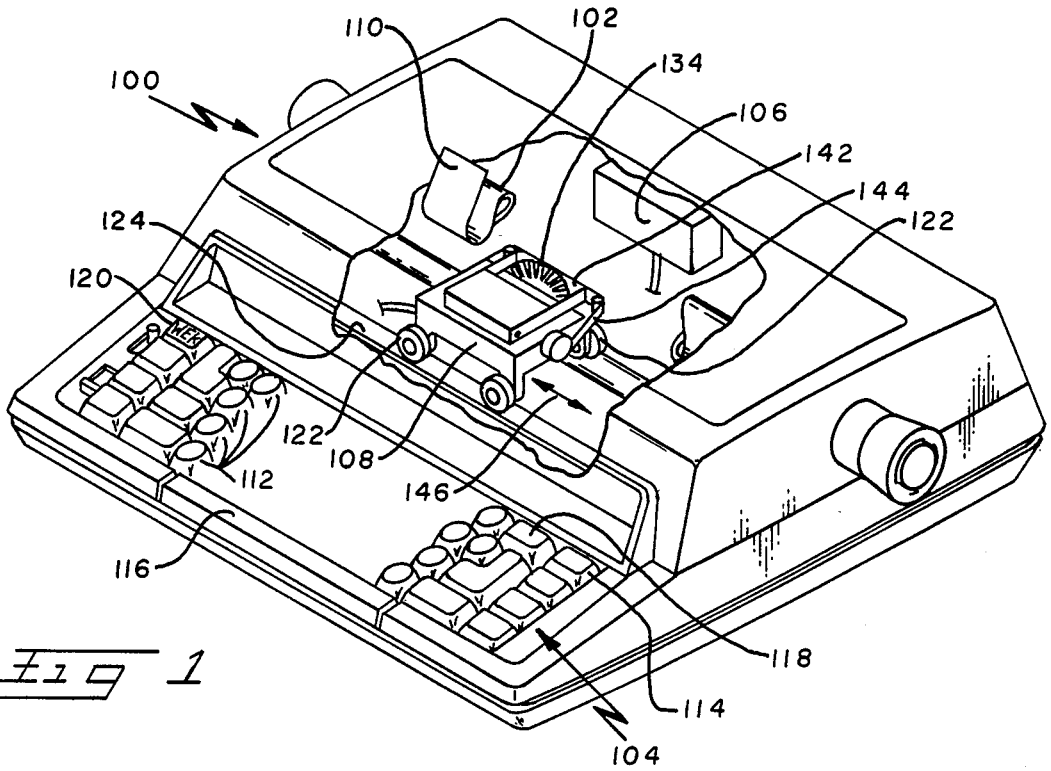
FIG. 1 is an isometric frontal view of an electronic correcting typewriter embodiment sectioned to show components operated according to the teachings of the present invention.

In FIG. 1, an electronic typewriter 100 is shown having basic components including a platen 102, a keyboard 104, a control circuit 106 and a carrier printing unit 108. The platen 102 serves to support and rotatively transport a sheet of paper 110 vertically in typewriter 100 for line typing as is usual. The keyboard 104 contains the usual plurality (44 or more) of character keys 112 and typewriter function keys including a backspace key 114, a spacebar 116 and a correct key 118. According to the preferred embodiment of the present invention a Word Erase Key (WEK) 120 is also located in the keyboard 104. Character keys 112 and function keys 114, 116, 118 and 120 of keyboard 104 are electrically coupled to control circuit 106 which in turn is electrically connected to carrier printing unit 108. Generally, selective operation of any keyboard key (112–120) generates, a corresponding unique signal communicated to control circuit 106 which is operated to control various outputs to the carrier printing unit 108 for controlling functional operation of typewriter 100 according to selected key outputs.

Figure 2:
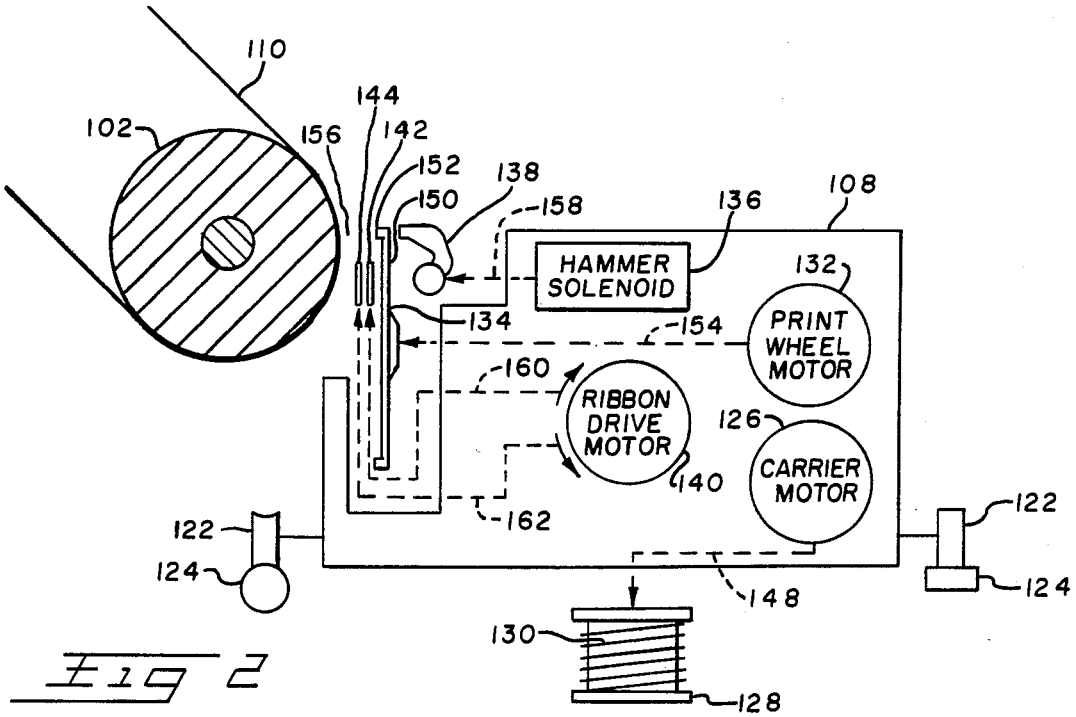
FIG. 2 is a schematic view of a print carrier and the platen of the electronic correcting typewriter of FIG. 1.

FIG. 2 shows a schematic diagram of the basic mechanisms assembled on carrier printing unit 108 and their relationship to platen 102. The showing of FIG. 2 is schematic only in order to facilitate an understanding; the actual preferred components are relatively detailed mechanically and such details are not directly relevant to the present invention. However, mechanical details of the components of FIG. 2 are more fully set forth in the above-mentioned patent cases III–VI, inclusive.

Carrier printing unit 108 supports a plurality of rotatable rollers 122 weighting on guide rails 124 horizontally extending in typewriter 100 parallel to platen 102. Assembled to carrier unit 108 are the following component mechanisms; a carrier drive mechanism comprising a carrier motor 126, a rotatable drive pulley 128 and a cable 130 wound about pulley 128 and having ends extending taunt to traverse platen 102; a printing mechanism including a print wheel motor 132, a print element 134, a hammer solenoid 136 and a pivotal hammer 138; and a ribbon mechanism comprising a ribbon drive motor 140, a print ribbon 142; and a correction ribbon 144 adjacent platen 102.

Carrier unit 108 can be controlled to move horizontally to the left or to the right, as indicated by arrows 146 in FIG. 1, by carrier motor 126 under control from control circuit 106. Drive pulley 128 is coupled so as to be rotatively driven by the carrier motor 126 through a mechanical linkage schematically represented by a dashed line 148. Cable 130 is wound about pulley 128 such that simultaneous winding and unwinding of cable 130 occurs when pulley 128 is rotatably driven to convert rotary drive from carrier motor 126 into linear motion of carrier unit 108. Carrier motor 126 is a known bi-directional stepper kind of motor providing precise incremental drive for moving carrier unit 108 in escapement or character moves (right or left) to any horizontal character print line position along paper 110. Escapement moves along the print line may be according to a selected keyboard pitch mode, such as, 10, 12 or 15 character spaces per inch.

Preferably print element 134 is a print wheel, also known as a "daisy" wheel, having a plurality of radial resilient petals or spokes 150 individually supporting a respective character or symbol 152 of keyboard character keys 112. Print wheel motor 132 is coupled to rotatably drive print wheel 134 through a mechanical arrangement schematically represented by a dashed line 154 so that any character petal 150 may be angularal located upright at a printing station 156 for impact printing. Print wheel motor 132, like carrier motor 126, is a known bi-directional stepper kind of motor whose operative drive is controlled from output of control circuit 106. Hammer solenoid 136 is also under the control of control circuit 106 for causing print hammer 138, via linkage schematically represented by dashed line 158, to strike an upright petal 150 carrying the selected character 152 responsive to when that character 152 arrives at the printing station 156, as is well-known to those skilled in the art.

Print ribbon 142 and correction ribbon 144 normally rest in a fore-and-aft relation at a location beneath the print station 156 to permit observation of previously typed characters along the print line. Ribbons 142 and 144 are operated by ribbon drive motor 140 under control of control circuit 106. Ribbon drive motor 140, like motors 126 and 132, is a known bi-directional stepper kind of motor. Dashed line 160 represents a mechanical linkage for operating print ribbon 142 when ribbon drive motor 140 is caused to rotate in one direction, e.g., clockwise. In a normal typing mode of typewriter 100, print ribbon 142 is operated by ribbon drive motor 140 for causing the print ribbon 142 to lift from its illustrated rest or down location to a location at printing station 156 for print transfer. Mechanical motion from linkage 160 serves to horizontally feed print ribbon 142, either before or after print, past the carrier print point to supply fresh ribbon for printing. Dashed line 162 represents a mechanical linkage for enabling correction ribbon 144 when ribbon drive motor 140 is driven in the opposite direction, i.e., counterclockwise. In correction mode of typewriter 100, the correction ribbon 144 is enabled through counterclockwise rotation of ribbon drive motor 140 for causing the correction ribbon 144 to lift from its illustrated rest or down location to the location at printing station 156 for impact transfer of correction medium. Mechanical motion from linkage 162 serves to feed the correction ribbon 144 in conjunction with lift and fall motion of correction ribbon 144. When the print ribbon 142 is operated, correction ribbon 144 remains at rest and when the correction ribbon 144 is enabled, the print ribbon 142 remains at rest. The print ribbon 142 may be an inked fabric or carbon film kind of ribbon and the correction ribbon 144 may have an adhesive or white overlay coating correction medium appropriate for erasing printed characters.

Figure 3:
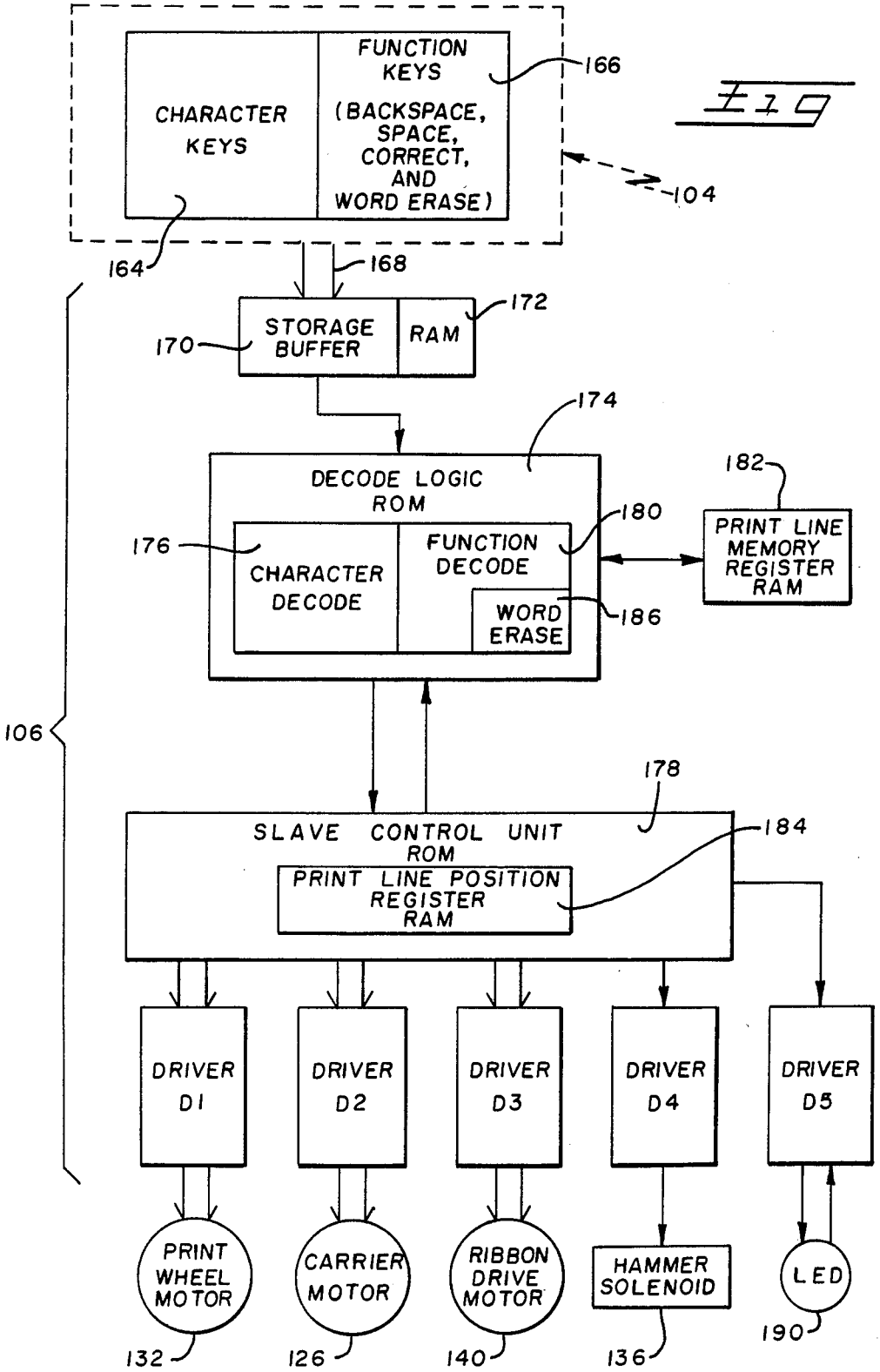
FIG. 3 is a block diagram of the electronics for controlling functional operations of the typewriter including a word erase control function.

Referring to FIG. 3, there is shown a block diagram of the electronic system of control circuit 106 to effect typewriter 100 operations according to any selected keyboard key. In practice, all the components in control circuit 106 may be formed within a single integrated circuit including a programmed central process unit (CPU) or microprocessor. Only electronic components relevant to the understanding of the present concept are shown for clarity sake.

In FIG. 3, character keys 112 of typewriter keyboard 104 (FIG. 1) are grouped in block 164 and special function keys, such as, back-space 114, spacebar 116, correct 118 and Word Erase Key 120, are grouped in block 166 of keyboard 104. Upon actuation of any key in keyboard 104, a unique code signal representative of the depressed key is transmitted, via date buss 168, to a storage buffer 170 of control circuit 106. Buffer 170 includes a RAM unit 172 that operates to temporarily hold or store, if necessary a plurality (20 total capacity) of received keyboard output codes while electrical transfer of one code takes place. Code transfer from buffer 170 to subsequent circuitry is in the order that each code was received and code transfer occurs after typewriter 100 has operatively processed a preceding code. Typewriter 100 is thus afforded sufficient time to operate various motors and mechanical linkages in performing typewriter functions without sacrifice of typing speed. An available key code signal identified (via electronic scan) in buffer 170 is applied to a decode logic ROM 174 for the purpose of converting the transferred key code signal into an appropriate signal for operating typewriter 100.

A character decoded block 176 of decode logic ROM 174 converts character key code signals originating from block 164 of keyboard 104 into character control signals appropriate for printing selected character positions on print wheel 134. Character control signals from block 176 of decode logic 174 are applied to a slave control unit ROM 178 of control circuit 106 to effect operation of drivers (D1–D4) for print functioning according to the selected character key. Driver D1 is coupled to operate the print wheel motor 132 for causing the print wheel 134 to rotate so as to position the selected character upright at printing station 152 for printing. Print wheel 134 may be driven by motor 132 to rotate in either direction to provide the shortest angular path of travel from one character to the next in order to minimize print wheel movement and to facilitate typing speed. Driver D2 is connected to operate carrier motor 126 for incrementally moving carrier unit 108, via mechanical connection 148, pulley 128 and cable 130 of FIG. 2. Carrier motor 126 may be operated by driver D2 to rotate in either direction for moving carrier unit 108 either to the right or to the left along platen 102 in typewriter 100. A character control signal in slave control unit 178 causes driver D2 to operate carrier motor 126 for moving carrier unit 108 one character position to the right for printing. Driver D3 is coupled to operate ribbon motor 140 for operating print ribbon 142 when ribbon motor 140 is controlled to rotate in one direction (clockwise in FIG. 2) and for enabling correction ribbon 144 when ribbon motor 140 is controlled to rotate in the opposite direction (counterclockwise). Character control signals in slave unit 178 controls driver D3 for operating ribbon motor 140 to lift print ribbon 142. Driver D4 is connected to operate hammer solenoid 136 for actuating hammer 138 for causing impact printing. Driver D4 is controlled by slave unit 178 to operate in conjunction with drivers D1–D3 so that impact printing occurs after the selected print wheel character 152 is rotated upright by driver D1, the print ribbon 142 is operated (elevated) through driver D3 and carrier unit 108 is located at the position the selected character is to be printed by driver D2.

A function decode block 180 of decode logic ROM 174 is utilized to convert any function code signals originating from block 166 of keyboard 104 into a control signal appropriate to cause operation of the selected typewriter function. Function control signals are also applied to slave control unit ROM 178 to effect selective drives (D1–D4) for operating typewriter 100 according to the selected function key, as described below. As all key code signals (character and function) are decoded in decode logic ROM 174 for subsequent utilization in slave control unit ROM 178 for appropriate driver selection, that same information is temporarily stored in a print line memory register RAM 182. Memory RAM 182 is an addressable register capable of receiving and temporarily storing data signals in an ordered sequence corresponding to a full print line of character positions. Also, print line memory register RAM 182 may be sequentially read up or down via electronic scan to identify stored character or function control signals previously entered at any position along the print line.

A print line position register RAM 184 of slave control unit ROM 178 is operable to provide current information in control circuit 106 as to the present position of the carrier print point as measured from the leftmost margin position. The position count value in register RAM 184 is constantly updated as the carrier unit 108 translates left or right under the control of any keyboard actuated signal.

When spacebar 116 (FIG. 1) is depressed (shallow for effecting a single "space" operation) a unique "space" code signal is generated via buss line 168 to storage buffer 170. RAM 172 continually operates to electronically scan storage buffer 170 to see if any key code is available for transfer to decode logic ROM 174. The "space" code signal is sequentially applied to function decode block 180 upon electronic transfer of this code from buffer 170 to decode logic ROM 174. Function decode block 180 operates to convert the received "space" code into a control signal of appropriate form to operate slave control unit ROM 178 for causing a "space" function of the carrier print point along the print line. Simultaneously, the "space" control signal information of function decode block 180 is applied for sequential placement in print line memory register RAM 182. In slave control unit ROM 178, the "space" control signal is utilized to effect operation of only driver D2 for causing carrier motor 126 to move the print point of carrier unit 108 one position to the right thereby leaving a "space" or non-print vacancy on paper 110. In the event the spacebar 116 is depressed to the deep position, a repeat mode of typewriter 100 is effected by a bail-switch combination (not shown) to repeatedly cause "space" functioning along the print line.

Operation of backspace key 114 causes electronic events to occur similar to spacebar 116, except that, a backspace control signal communicated to slave control unit ROM 178 causes drive D2 to operate carrier motor 126 for moving the print point of carrier unit 108 to the left one position for a shallow backspace key actuation. Repeat backspace functioning is effected when backspace key 114 is depressed to a deep position.

Selection of correct key 118 causes automatic erasure of a previously typed character occupying the current print point position of carrier unit 108. Depression of correct key 118 enables operation of character correction mode of the typewriter 100 as follows: a unique character correct code signal is generated from function key block 166 to storage buffer 170; RAM 172 transfers, when made available, character correct code signal from storage buffer 170 to decode logic ROM 174, and, more particularly to function decode block 180; block 180 operates to convert the character correct code signal into a single character correction control signal usable through slave control unit ROM 178 for causing erasure of the previously printed character at the print point position of print line position register RAM 184; and print line memory register RAM 182 is addressed by the print line position register RAM 184 to identify the previously printed character at the carrier print point for recalling that printed character data control signal communicated to slave control unit ROM 178. In the character correction mode, the recalled character control signal in slave control unit ROM 178 operates driver D1 for causing print wheel motor 132 to rotatably drive print wheel 134 to locate the recalled character petal at printing station 156. Driver D3 is operated to cause ribbon motor 140 to enable correction ribbon 144 for lifting the correction ribbon 144 to the printing station 156. Driver D4 is orderly operated to energize hammer solenoid 136 for causing the impacting of the erasure medium of correction ribbon 144 against paper 110 to effect character erasure. Driver D2 is also operated to drive carrier motor 126 so that the print point of carrier unit 108 is located to permit normal typing in the erased position.

In accordance with the present word correcting system, a word erase control logic block or flag 186 is included as part of the function decode logic 180 of decode logic ROM 174. Word erase block 186 operates to control word correction mode of typewriter 100 for effecting automatic erasure of a printed word or a series of words as is described below. A printed word is defined in the present system as a continuous series of consecutively printed characters bordered by a "space" or non-print function.

When word erase key 120 is actuated, a unique word erase code signal is generated on buss line 168 to storage buffer 170. When buffer 170 is empty of preceding codes, the word erase code is applied to decode logic 174 and, specifically, word erase block 186 of function decode logic RM 180. (When the word erase code signal from function keys 166 of keyboard 104 enters buffer 170 while buffer 170 is holding any preceding codes, the word erase code signal is sequentially held in buffer 170 on a first in-first out basis until all other preceding codes have been processed by typewriter 100.) The word erase code signal in decode logic ROM 174 conditions (sets a word erase flag) word erase block 186 for conversion into an appropriate control signal transmitted to slave control unit ROM 178 for effecting word correction mode. Decode logic ROM 174 is constantly being electronically checked or interrogated according to well known microprocessor practice to identify any true or set data flags. Upon finding the word erase command of block 186, the word erase control signal is applied to slave control unit ROM 178 and then, through print line position register RAM 184, the print line memory register RAM 182 is accessed. Print line memory register RAM 182 is electronically scanned to identify the exact position of the rightwardly end of the unwanted word on the print line in relation to the current position of the print point of the carrier unit 108 when the Word Erase Key 120 was actuated. The described electronic sequence accessing print line memory 182 in control circuit 106 occurs for each actuation of Word Erase Key 120. Subsequent electronic events in FIG. 3 for causing word erase functioning depend upon the location the word wished to be erased along the print line in relation to the current carrier print point location. For a clearer understanding of the remaining electronic word erase events of FIG. 3, reference is made to FIG. 4 wherein a print line 188 has its escapement character move positions numbered from 18 through 54 as measured from the leftmost margin or zero (0) position.

Figure 4:
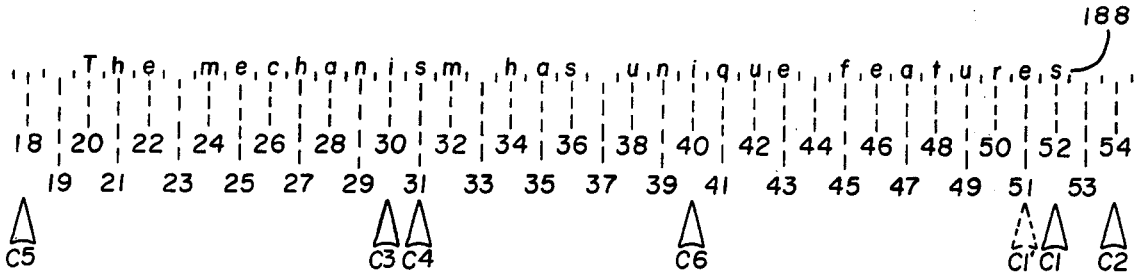
FIG. 4 is a front view of a partially printed line for illustrating carrier movement to effect word correction mode for various carrier print point positions.

In FIG. 4, it is assumed that typing is in progress and that the words "The mechanism has unique features" has been typed in positions #20–#52 along print line 188 and that the typed information is sequentially stored in print line memory register RAM 182. Triangular pointers or cursors C1–C6 illustratively represents the print point of carrier unit 108 located along print line 188 for various situations described below.

Firstly, assume that in this situation, the typist wishes to erase the most recently typed word "features" after the "s" has been typed as is represented by cursor C1 resting at the last typed position #52. To erase a last typed word in this situation, the typist actuates (depresses) Word Erase Key 120 for causing typewriter 100 to automatically operate in word correcting mode to erase all printed characters of the word. Returning to FIG. 3, after the true word erase condition of block 186 is identified, print line memory register RAM 182 is accessed under control of print line position register RAM 184 to electronically determine if a previously printed character is occupying the current carrier print point position of cursor C1. As a result of this electronic check of print line memory register 182, the control signal of the printed character "s" is found causing a subsequent of further interrogation of higher order positions of print line memory register RAM 182 to determine if a printed character is occupying the next right position (#53). Since no previously printed character is in the next right position (#53), the typewriter 100 is preprogrammed to assume that the non-print position #53 is the end of the word and the printed character "s" is caused to be recalled from print line memory register RAM 182 for initiating word correction mode. A reprint character control signal in correction mode is issued to slave control unit ROM 178 causing driver D1 to operate print wheel motor 132 for rotating print wheel 134 to locate the recalled "s" character petal upright, driver D3 to operate ribbon motor 140 (counterclockwise, FIG. 2) for enabling correction ribbon 144 to lift to the printing station 156 and driver D4 to fire hammer 138 for impacting the erasure medium through the selected petal 150 against paper 110 to effect erasure of the "s" character. Simultaneously, a "space" signal is put into print line memory register RAM 182 in the position (#52) vacated by the recalled character. Print line memory register RAM 182 is then caused to have the next lower order position interrogated to determine if there is a printed character in the next left position (#51). Since the print control signal representing the letter "e" is found in the next left position (#51), driver D2 is caused to operate carrier motor 126 for moving the print point of carrier unit 108 one position to the left, to that position (#51). The character code ("e") is caused to be recalled from print line memory register RAM 182 and applied to slave control unit ROM 178 in correction mode for erasure of the previously typed "e" character. The above automatic erasing sequence continues as long as print line memory register RAM 182 continues to read an erasable (previously printed) character in the position immediately adjacent to the left of the most recently erased position. After the character "f" has been erased at position #45, print line memory register RAM 182 is interrogated to read if a printed character is in the next left position (#44). This reading check reveals a "space" function code at position #44 so that no printed character control signal is available for recall. The first left found "space" function (position #44) during word correction mode is viewed by typewriter 100 as marking the beginning of an unwanted word. As a result, typewriter processing of the word erase command is complete and the carrier unit 108 is stopped. Interrogation is returned to storage buffer 170 for typewriter processing of any key codes that may have been stored subsequent the just processed word erase input.

Secondly, assume that the typist wishes to erase the most recently typed word "features" after e.g., two "space" functions to the right of the last typed character have occurred so that the print point indicator (cursor C2) is pointng at position #54 (FIG. 4). In this situation the typist actuates the Word Erase Key 120 causing an electronic check or scan in print line memory register RAM 182 to read whether a printed character is occupying the print point cursor position C2. Since no printed character is found in the present position of cursor C2, lower order value positions in print line memory register RAM 182 are caused to be read through interrogation in reverse ordered sequence (a "look" to the left operation) to determine if any previously printed characters are stored along print line 188 to the left of cursor C2. During this check, the last typed "s" is found at position #52 causing an appropriate carrier move left signal to be applied to slave control unit ROM 178 for operating driver D2 to cause carrier motor 126 to automatically backspace the print point of the carrier unit 108 to the first left character position (#52). Word erase mode of control circuit 106 is then operated as described in the previous first situation to automatically erase all characters comprising the word "features".

Thirdly, assume that the typist wishes to erase a word remote from the current carrier print point position and that a word or plurality of words have been typed after the unwanted word is discovered. For example, in FIG. 4 assume that the typist has typed to print line position #52 (cursor C1) and discovers that the typed word "mechanism" should be changed, e.g., to "apparatus". In order to delete the word "mechanism" using the presently disclosed Word Erase Key 120, the typist merely backspaces carrier unit 108, via backspace key 114, to move the print point to any print line position occupied by the unwanted word (positions #24–#32). Assume that after backspacing cursor C3 is randomly stopped at "i" position #30 and then Word Erase Key 120 is actuated. In FIG. 3, word erase flag of block 186 is set (true) causing print line position register RAM 184 to access print line memory register RAM 182 for interrogation to read if a printed character is occupying the current print point position of censor C3. In response to reading such a character ("i"), print line memory register RAM 182 is next caused to read to the right to determine if a print character is in the next right position (#31 of cursor C4). This ("look"-to-the-right) interrogation reveals that there is a printed character control signal ("s") in the next right print line position (#31). As a result, a move right control signal is communicated to slave control unit ROM 178 for only operating driver D2 for causing carrier motor 126 to advance carrier unit 108 one character position to the right. The cursor is now located at position #31, as is denoted by cursor C4. Print line position register RAM 184 is updated accordingly to again address print line memory register RAM 182 for checking to read if a printed character is occupying the next right position #32. Carrier unit 108 is caused to further move one position to the right when the printed character is found in the next right position (32). This sequence of carrier moves to the right continues until print line memory register RAM 182 fails to read a printed character in the next right position, such as occurs during interrogation at position #32. In response to reading the "space" function at position #33, the printed character "m" at the current position of carrier unit 108 is caused to be recalled from print line memory register RAM 182. The recalled character control signal is applied to in correction mode slave control unit ROM 178 for operating typewriter 100 in word correction mode until the first left "space" function of position #23 is reached to complete the processing of this word erase input command.

An important aspect of the present word correctng system resides in the fact that backspacing operation to the unwanted word need not be precise with respect to exactly aligning the print point indicator cursor of carrier unit 108 at a particular position in order to implement word correction mode. All that is required is that the carrier be stopped at any character position occupied by the word as is evident in the above-description. Thus, extreme care need not be exercised by the typist when operating backspace to precisely position the print point indicator cursor for correction.

Fourthly, assume that the typist mistakenly actuates Word Erase Key 120 when carrier unit 108 or cursor C5 is located, e.g., at position #18 to the left of any printed characters. Returning to FIG. 3, upon address of print line memory register RAM 182 from print line position register RAM 184, the ordered value of the current cursor position C5 is read in memory register RAM 182 to determine if ay previously typed characters are stored in any lower order positions. The determination of this ("look"-to-the-left) interrogation reveals no print control signals causing an appropriate signal to be issued to slave control unit ROM 184 that fails to operate any of the drivers D1–D4 and carrier unit 108 remains stationary with no mechanical action of printing components occurring. In a preferred embodiment of typewriter 100, a driver D5 may be operated by slave control unit ROM 184 to activate a light emitting diode (LED) 190 when the above-mentioned signal failing to operate drivers D1–D4 is caused. LED 190 may then serve as a warning light to the typist that the selected function (Word Erase) cannot be properly processed by typewriter 100.

In order to erase more than one word in a series, Word Erase Key 120 is successively actuated a number of times equalling the number of words wished to be erased. For example, assume that after typing on print line 188 of FIG. 4, the typist wishes to erase the last three printed words "has unique features" in positions #34–#52 when cursor is resting at C1. Word Erase Key 120 is successively actuated three distinct times for generating three individual word erase code signals sequentially applied to storage buffer 170. The first word erase code signal released from buffer 170 causes the last typed word "features" to be automatically erased as described above. After the first word erase code signal has been processed to erase the last typed word "features", storage buffer 170 is again interrogated to thereby release the second sequential word erase code signal. Typewriter 100 is again operated in word correction mode to erase the second unwanted word "unique". After the second word erase code has been processed, automatic word correction continues to erase the word "has" in response to the third successive word erase code. Word correction mode is stopped after the "space" function preceding the last unwanted word is electronically sensed and no further word erase command code is found in storage buffer 170.

To erase a series of words remote from the current carrier position, the typist merely backspaces carrier unit 108 to locate print point indicator cursor at any one position occupied by the last unwanted word and then Word Erase Key 120 is successively actuated a number of times as mentioned above. For example, assume that the typist wishes to erase the words "mechanism has unique" when cursor C1 is at position #52 of FIG. 4. To accomplish this, the typist backspaces carrier unit 108, via backspace key 114, to any one of the positions #38–43 comprising the last unwanted word. Assume the typist has randomly stopped carrier unit 108 at position #40 of cursor C6 and Word Erase Key 120 is then successively actuated three times. As described above, responsive to the first word erase command code, carrier unit 108 is electronically operated to first progressively move to the right to locate the first right "space" function. This "space" function of position #44, when electronically sensed after cursor C6 has reached position #43, causes typewriter 100 to operate in word correction mode to erase the three unwanted words in the automatic manner set forth above.

Figure 5:
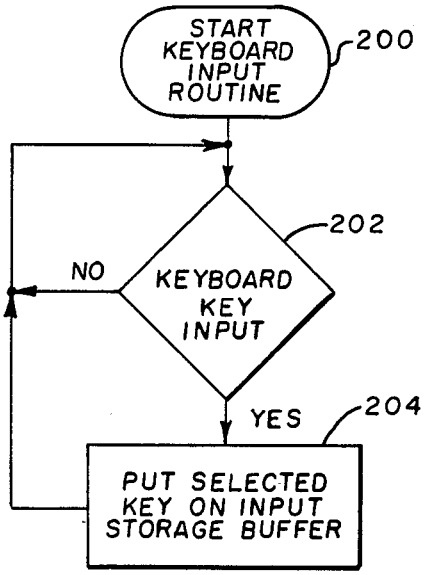
FIGS. 5 through 7 are logic flow charts of logic operations performed in the electronics of FIG. 3.
Figure 6:
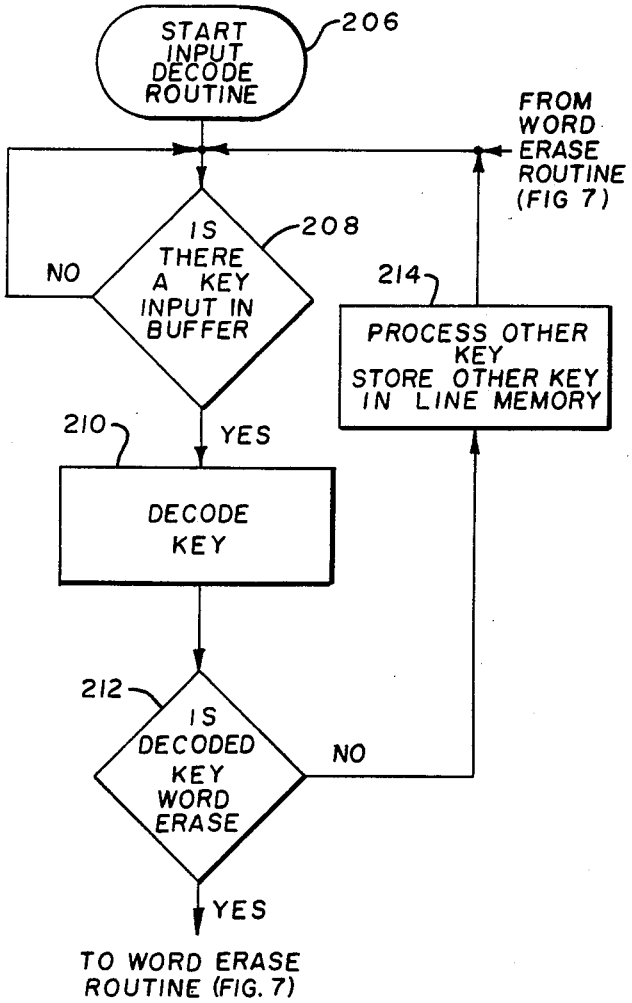
Figure 7:
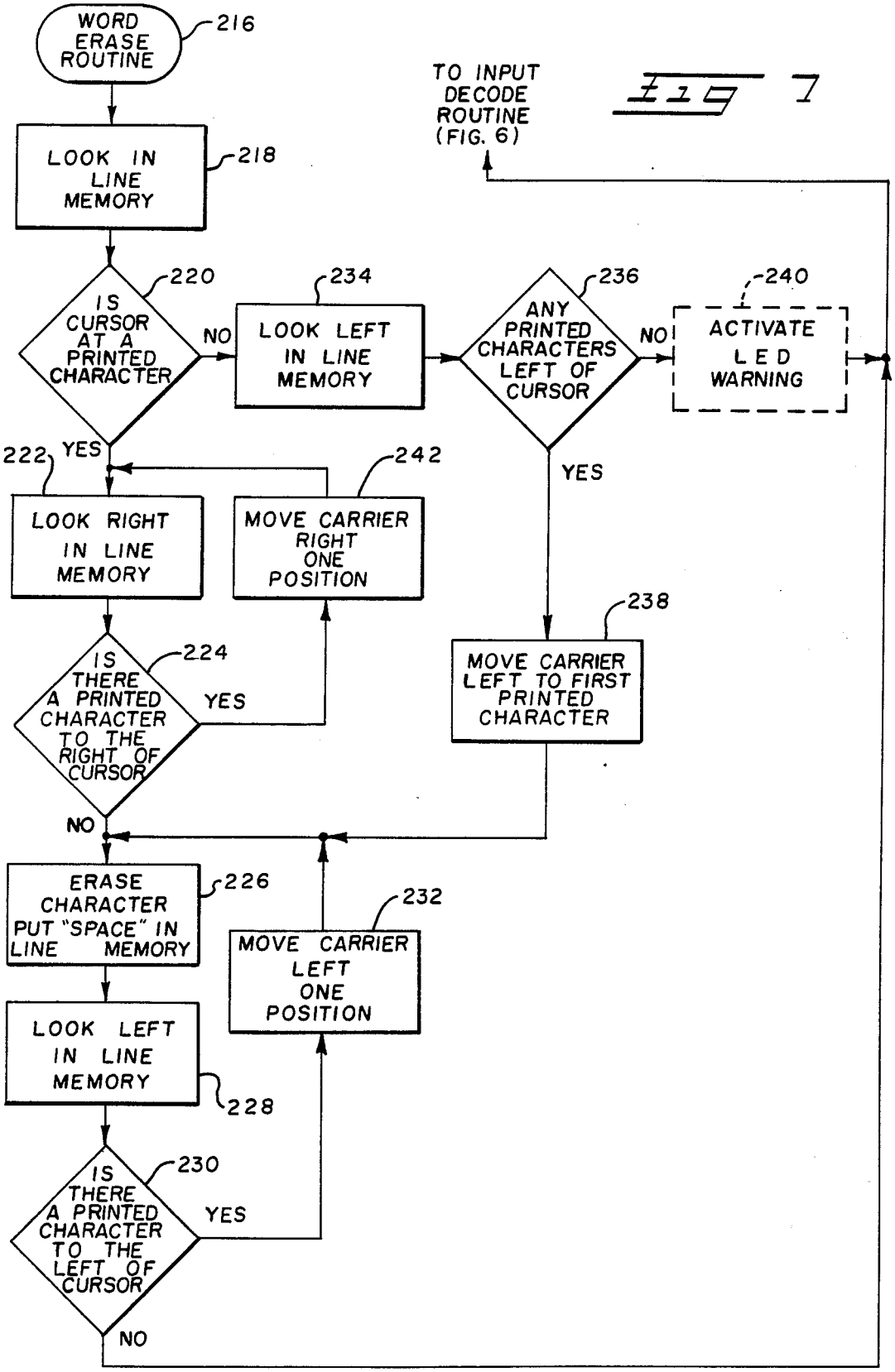

In the flow charts of FIGS. 5, 6 and 7, the various blocks depict individual operations which occur within control circuit 106 and in typewriter 100 relevant to the present word correcting system. The order of progression of the blocks depicts the sequence of these operations, in accordance with well known flow chart terminology. In these flow charts the following conventional blocks are used: rectangles represent a processing function or an operation; and a diamond represents a decision for selecting one of two alternative outputs.

As with most microprocessors, the control circuit 106 of FIG. 3 has a regular idling routine in which it makes rounds or sequential interrogations of various flags or conditions and initiates certain routines or operations if the flags or conditions are true (or not true). Only routines relevant to the word correcting operation are depicted in the flow charts. Other routines which may be taken by the machine during a correction operation are not detailed. However, certain of these other routines are discussed in the cases listed supra.

Block 200. In the flow chart of FIG. 5, it is assumed that at start block 200, typewriter 100 in ON and that normal typing is in progress so that the machine is operating in its normal idling routine. The idling routine contains many decision or interrogation points, but only those relevant will be discussed.

Block 202. As part of the idling routine, the logic causes a query as to whether any keyboard key (character or function) code has been received, as indicated by diamond (decision) block 202. If not, the NO decision of block 202 is looped back to start block 200 repeatedly as is illustrated. Actuation of any key in keyboard 104 generates a representative code signal causing the determination of block 202 to become YES.

Block 204. In block 204 all keyboard key code signals are applied to the storage buffer 170 of control circuit 106 for temporary holding when other preceding key code signals are yet to be processed by typewriter 100.

The routine flow of FIG. 5 is common to all keyboard 104 key operations.

The flow chart of FIG. 6 generally illustrates the routine of control circuit 106 for decoding all keyboard code signals as such code signals become available from storage buffer 170.

Block 206. At the start of the decode input routine, buffer 170 is operated, via RAM 172, to continually interrogate its status as to whether any code signals are present in buffer 170.

Block 208. In block 208 the decision is made regarding the status of buffer 170 with respect to whether there is an available key code. This decision is made, e.g., after processing of a previous code. Buffer 170 is periodically checked (on a regular idling routine bases) as is indicated by the NO decision looping back to start (block 206) if buffer 170 is empty.

Block 210. Assuming that a key code signal is found in buffer 170, the available code signal is transferred by the YES flow from block 208 to operation block 210 for decoding purposes. Block 210 represents the operation of decode logic 174 wherein the received key code signal is converted by conditioning or setting of the appropriate flag for effecting typewriter operation according to the selected key.

Block 212. Many decisions are made in block 212 as the result of the decoding operation in block 210. Basically the decision is made as to whether the converted code signal is that of a character key of logic 176 or a function key of logic 180. The present application is concerned with the decision regarding whether the converted key code signal is that of the Word Erase Key 120 based on interrogation of word erase flag 186 in function decode 180 of decode logic 174.

Block 214. If the decision of block 212 is NO, (meaning that the converted key code is other than that of word erase), the other converted code is processed through other appropriate routines not relating to the present application. The other processed key is normally stored in print line memory register 182 and after the processing of the other key code, typewriter 100 is caused to return to the start of the decode input routine at block 206. If the decision of block 212 is YES, the flow is progressed to the word erase routine of FIG. 7.

The flow chart of FIG. 7 illustrates the word erase routine that ultimately effects erasure of a word or a series of words according to the teachings of the present word correcting system. Various paths in the flow chart of FIG. 7 may be taken dependent upon the current location of the print point of carrier unit 108 in relation to the character positions of the word to be erased along print line 188 when the Word Erase Key is actuated. The discussion of FIG. 7 is best understood in view of FIG. 4 and each flow path his explained separately to facilitate referral between the drawings and explanation.

Block 216. In the flow chart of FIG. 7, the start of word erase routine is indicated by block 216. At this point, assume that the typing shown in FIG. 4 has been processed and that the converted word erase code found in decision 212 of FIG. 6 is the result of the typist actuating Word Erase Key 120 when the print point indicator of carrier unit 108 is in position #52 of cursor C1. The flow path taken in FIG. 7 as a result of this Key 120 actuation is the most direct path going straight down from start block 216.

Block 218. At the beginning of the word erase routine, the word erase control signal causes print line position register 184 of slave control unit 178 to access the print line memory register 182 (block 218). This check of print line memory register 182 is a status check of the current print point position of cursor C1 to determine what key information is contained at that position (#52).

Block 220. The decision of block 220 is to determine if print line memory register 182 contains a previously printed character in the position of cursor C1. In the example of cursor C1, the previously typed "s" information is found.

Block 222. If a (YES) printed character is contained in the current print point position of cursor C1—the decision of block 220—, print line memory register 182 is again accessed to check or read the status of the position (#53) immediately adjacent to the right hand of cursor C1.

Blocl 224. The decision of block 224 is to determine whether the position immediately adjacent to the right of cursor C1 is occupied by a previously printed character or a non-printed function, i.e., "space". If a non-printed or "space" function is found contained in the next right position #53, cursor C1 is assumed to be presently located at the end of a word and the flow is NO from block 224.

Block 226. Accordingly, typewriter 100 and, more specifically, slave control unit 178 is operated here in correction mode to effect erasure of the found character, as previously described. Simultaneously, a "space" function control signal is caused to be entered at the position #52 previously containing the now erased character.

Block 228. Upon completion of the operations of block 226, print line memory register 182 is again accessed to check or read the position (#51 denoted by dashed line cursor C1') immediately adjacent to the left of the just erased character, as is indicated in block 228.

Block 230. The decisions of block 230 is to determine if the next left position (#51) contains a previously printed character. In the present example of broken line cursor C1' (prime), the "e" in position #51 is found and the flow proceeds, via YES path, to block 232.

Block 232. Here carrier unit 108, under control from slave control unit 178, is moved one character position to the left of cursor C1, so that cursor C1 is displaced one position to the left as indicated by the dashed lined cursor C1'.

The flow from block 232 is looped back to block 226 for effecting erasure of the second consecutive character ("e" of position #51) located to the left of the erased character. This loop path comprising blocks 226, 228, 230 and 232 is repeated automatically until the decision of block 230 reveals no previously printed character in the next left position. Upon a NO decision from block 230, the flow is returned to block 208 of FIG. 6 for interrogation of buffer 170 to determine if a key waiting code signal is presently being held for processing.

The NO decision of block 230 represents the first found "space" or non-print function contained in print line memory register 182 to the left of the erased characters. The control circuit 106 is prearranged to assume that this first left vacant position (#44 in the referred example) represents the beginning of the unwanted word (now erased).

Returning now to FIG. 4, assume that the typist wishes to erase the word "features" and that two "space" functions have been processed in subsequent positions #53 and #54. Word Erase Key 120 is then actuated when carrier unit 108 is in the position denoted by cursor C2.

Typewriter 100 is operated to proceed through the keyboard routine of FIG. 5 and the input decode routine of FIG. 6, traversing blocks 200 through 212 in the manner previously described. The word erase condition is determined true (YES) at block 212 (FIG. 6) causing the flow to continue to the word erase routine of FIG. 7. In FIG. 7, the current carrier print point position (cursor C2) in print line memory register 182 is interrogated under control of print line position register 184 at block 218. The decision of block 220 is made, resulting in a NO determination because the "space" function contained at position #54 is found.

Block 234. Here print line memory register 182 is caused to be interrogated or read in a manner "looking" left. In this operation, lower order positions of the print line memory register 182 are checked sequentially in reverse order from the current carrier print point position towards the left margin.

Block 236. Decision block 236 determines the status of preceding positions with respect to whether there are any printed characters contained in print line memory register 182 to the left of cursor C2. Specifically, print line memory register 182 searches to read a first left printer character. As a result of the "look" left search, the printed character "s" contained at position #52 is found causing the flow to proceed along the YES path to block 238.

Block 238. Here slave control unit 178 is operated under control of the above found printed character control signal in memory 182 for causing carrier unit 108 to automatically backspace to the position (#52) of the first left printed character.

From block 238, the flow proceeds to block 226 where typewriter 100 is operated in word erase mode for first, erasing the last character "s" of the unwanted word and then progressing to the left along print line 188 to erase all characters of the unwanted word. This is accomplished in the flow chart of FIG. 7 through the loop path of blocks 226, 228, 230, 232 being repeatedly followed until the "space" function at position #44 is sensed by print line memory register 182. At this point the NO decision of block 230 is made causing the flow to return to block 208 of FIG. 6. The unwanted word has been completely erased automatically and carrier unit 108 is stopped (under control of the "space" position of #44 being operated in slave control unit 178) at erased position #45 so that new printed characters may now be typed in the erased positions.

Returning to decision block 236, if no printed characters are found contained in print line memory register 182 to the left of the carrier unit 108, such as, occurs when cursor is at C5 (position #18), the flow immediately returns to the beginning of the input decode routine of FIG. 6. Since typewriter 100 cannot properly operate according to the word erase command in this situation, the carrier unit 108 is caused to remain stationary.

Block 240. In a preferred embodiment, the NO flow from decision block 236 is passed through dashed line block 240 in returning to the beginning of the input decode routine of FIG. 6. Block 240 represents operation of driver D5 in lighting LED 190 (FIG. 3) under control of slave control unit 178 in response to the "space" or non-printed functions found in print line memory register 182 to the left of cursor C5. The lighted LED 190 serves as a visual warning to the typist that the selected key (Word Erase Key 120) cannot be properly processed by typewriter 100.

Returning again to FIG. 4, assume now that the typist wishes to erase the word "mechanism" and that the three subsequent words have been typed so that the print point indicator of carrier unit 108 is at position #52 of cursor C1. To erase an unwanted word remote from the carrier, the typist merely backspaces, via backspace key 114, to any one of the positions (#24–#32) occupied by the unwanted word. For example, assume that after backspacing the print point indicator of carrier unit 108 is stopped at position #30 (cursor C3) occupied by the typed character "i". Word Erase Key 120 may be actuated to effect complete erasure of the unwanted word "mechanism" as is described below in connection with the flow chart of FIG. 7.

In response to actuation of Word Erase Key 120, typewriter 100 is operated according to the flow through the blocks in FIGS. 5 and 6 to FIG. 7, as before. The current cursor C3 position is accessed in print line memory register 182 (block 218 of FIG. 7) and a YES decision is made from block 220. The flow from block 220 is the YES path because the printed character "i" is identified. Print line memory register 182 is again accessed at block 222 to "look" right to identify the status of the next right position #31. The decision of block 224 is YES due to the finding of the printed character "s" contained in position #31.

Block 242. From the YES path extending from block 224, the flow proceeds to operation block 242. Here the carrier unit 108 is moved one position to the right under control of slave control unit 178. Only driver D2 is operated to advance carrier unit 108, the remaining drivers D1 and D3–D5 are not operated during this move to the right.

After the carrier unit 108 arrives at the next right position (that of cursor C4), the flow from block 242 is returned to block 222 and print line memory register 182 is again accessed to "look" right (block 222). This loop flow path comprising blocks 222, 224 and 242 is repeated until the decision of block 224 is NO. The NO decision of block 224 is reached when the print point indicator of carrier unit 108 reaches position #32 and the "look" right decision of block 224 identifies the "space" function of position #33. The NO path from block 224 extends to operate typewriter 100 in word erase mode through the loop path comprising blocks 226, 228, 230 and 232. This path is repeated, as before, until the unwanted word is erased, and the NO decision of block 230 is reached in response to the print line memory register 182 identifying the "space" function contained in preceding position #23. The flow next proceeds to the beginning of the input decode routine of FIG. 6 and the automatic word correction operation is now complete.

In order to effect automatic erasure of more than one word in a series, the Word Erase Key 120 is actuated in key stroke fashion a number of times equalling the number of consecutive words wished to be erased. Assuming that no other key codes are in buffer 170 (since any such preceding codes would be processed first), Word Erase Key 120 is successively actuated. Immediately, the first word erase code entered by the first actuation of Key 120 is acted upon. Typewriter 100 is ultimately operated in word erase mode (loop of blocks 226, 228, 230 and 232) for erasing the last unwanted word. The first word erase command proceeds through the flow of FIG. 6 to FIG. 7. In FIG. 7 the flow path taken to the beginning of the word erase mode (block 226, first pass) is according to the print point position of the carrier unit 108 when the first actuation of Word Erase Key 120 occurred, as is described above. After the first unwanted word is automatically erased, the flow returns to the beginning of the input decode routine of FIG. 6 where the decision block 212 discovers the presence of a second consecutive word erase command. In FIG. 7 typewriter 100 is then operated according to the flow path progressing through blocks 218, 220, 234, 236 and 238 to automatically reach the beginning of the word erase mode causing erasure of the next left word. This word erase sequence is repeated for all selected word erase commands so that any number of words in a sequence on print line 188 may be automatically erased through corresponding multiple key stroke selection of Word Erase Key 120.

While the above description contains many specifics, these should not be considered as limiting the scope of the invention since many ramifications of the embodiment described will be apparent to those skilled in the art. For example, carrier movement during correction mode may be made to include a forward move to the right after the character erase operation and then moved backwards to the next to be erased character for accommodating removal of an adhesive kind of correction ribbon material in peeling fashion. Also, while the present word correcting system is preferably disclosed as including Word Erase Key 120 in keyboard 104, the word erase code command utilized in control circuit 106 for effecting automatic word erase mode may be generated by other key means, such as, by the correct function key 118. Other variations can be made within the scope of the invention. Accordingly, it is therefore submitted that the true scope of the invention should be determined only according to the appended claims and their legal equivalents.

What is claimed is:

1. A word correcting system for an electronic correcting typewriter having a keyboard containing character and function key actuating means for generating output signals representative of actuated keys, print line memory means for storing an ordered sequence of control signals representing a sequence of actuated keys, print means including a print ribbon for printing a selected character at a print point on a recording medium and a correction ribbon for erasing previously printed characters, means for moving the print point of the print means along a print line of the recording medium including backspacing means for progressively moving the print point leftwardly along the print line, and means for accessing the print line memory means for reading selected locations of the ordered sequence, the word correcting system comprising:

word erase actuating means arranged in the keyboard for selectively generating a word erase command signal; and word erase control means responsive to said word erase command signal for causing the accessing means to read stored control signals in the print line memory means for initiating an automatic word erasing sequence causing all characters of a previously printed word to be erased after the operator has backspaced the print point of the print means to any previous consecutively printed character located at least one character position further to the left of the last printed character of the word which is to be erased, said automatic word erasing sequence includes first control means operating the accessing means to read the control signal at the word erase selected position and subsequently reading the control signal at the immediately adjacent higher order position in the print line memory means for moving the print point of the print means one character position to the right in response to reading a character control signal in the selected position and a character control signal in the next right higher order position and said first control means repeatedly operating to stop the print point at the last consecutively printed character of the word in response to reading an absense of a character control signal in the next right higher order position, and correction control means responsive to the print point reaching the last printed character of the word for operating the accessing means for recalling the character control signal and enabling the correction ribbon for erasing the last printed character whereupon the accessing means is further operated to read the immediately adjacent lower order position for moving the print point one character position to the left in response to reading a character control signal in the left most position and said correction control means repeatedly operating to stop the print point at a last left erased position in response to reading an absense of a character control signal in the next left order position.

2. The word correcting system of claim 1 further comprising:

means for sequentially holding a plurality of keyboard output signals including said word erase command signal for release to operate the typewriter in the sequence of operator actuated keys, such that, more than one consecutively printed word is erased in response to the operator successively actuating said word erase actuating means more than once and the total number of words erased corresponding to the number of successive actuations of said word erase actuating means.

3. A method of operating an automatic word correcting system in an electronic correcting typewriter having a keyboard containing character and function key actuating means for generating output signals representative of actuated keys, print line memory means for storing an ordered sequence of control signals representing a sequence of actuated keys including character control signals corresponding to operator actuated character keys and "space" control signals corresponding to operator actuated spacebar function key, print means including a print ribbon for printing a selected character at a print point on a recording medium and a correction ribbon for erasing previously printed characters, means for moving the print point of the print means along a print line of the recording medium including backspacing means for progressively moving the print point leftwardly along the print line, means for accessing the print line memory means for reading selected locations of the ordered sequence, and after the operator has backspaced the print point of the print means to any previous consecutively printed character located at least one character position further to the left of the last printed character of the word which is to be erased, operation of the automatic word correcting system comprising the steps of:

a. providing a word erase actuating means and a word erase control means for operating the typewriter in word erase mode;

b. generating a word erase command signal responsive to operator actuation of said word erase actuating means;

c. conditioning said word erase control means to control operation of the word erase mode upon receipt of said word erase command signal;

d. operating the moving means for moving the print point of the print means rightwardly from the selected position of said word erase actuating mean through consecutively printed characters;

e. stopping the print point of the print means at the last right printed character of the unwanted word;

f. enabling the correction ribbon for erasing printed characters in correction mode;

g. operating the typewriter repeatedly in correction mode to progressively move the print point of the print means leftwardly from the last printed character through all consecutively printed characters while erasing each printed character when aligned opposite the print point; and h. stopping the leftwardly movement of the print point at the last erased position corresponding to the position vacated by the first character of the erased word.

4. The method of claim 3 wherein operation of said conditioning step (c) further comprising the steps of :

c1. operating the accessing means to read the signal status in the ordered position of the print line memory means corresponding to the print point position of operator actuation of said word erase actuating means;

c2. accessing the print line memory means to read the next higher order position from position read in step (c1.) responsive to reading therein of a character control signal corresponding to a previously printed character;

c3. issuing a move control command to effect movement of the print point of the print means one character position to the right from the current print point position in response to step (c2.) reading a character control signal corresponding to a previously printed character in the next right position.

5. The method of claim 4 wherein operation of said operating step (d.) is accomplished through repeating steps (c1.) (c2.) and (c3.) until in step (c3.) said move control command to effect stoppage of the print point in response to step (c2.) reading the absense of a character control signal corresponding to a "space" control signal in the next right position.

6. The method of claim 5 wherein operation of said operating step (g.) comprising the steps of:

g1. recalling the character control signal having the "space" control signal in the next right position;

g2. reprinting the character of the recalled character control signal through the enabled correction ribbon for erasing that character;

g3. storing a "space" control signal in the position of the print line memory means vacated by the recalled character control signal;

g4. operating the accessing means to read the signal status of the next lower order position from the just erased position now containing the "space" control signal; and g5. issuing a backspace control command to effect movement of the print point of the print means one character position to the left in response to step (g4.) reading a character control signal corresponding to a previously printed character in the next left position.

7. The method of claim 6 wherein operation of steps (g1.) through (g5.), inclusive, are repeated until in step (g5.) said backspace control command to effect stoppage of the print point in response to step (g4.) reading the absense of a character control signal corresponding to a "space" signal in the next left position.

8. A method of operating an automatic word correcting system in an electronic correcting typewriter having a keyboard containing character and function key actuating means for generating output signals representative of actuated keys, print line memory means for storing an ordered sequence of control signals representing a sequence of actuated keys including character control signals corresponding to operator actuated character keys and "space" control signals corresponding to operator actuated spacebar function key, print means including a print ribbon for printing a selected character at a print point on a recording medium and a correction ribbon for erasing previously printed characters, means for moving the print point of the print means along a print line of the recording medium including backspacing means for progressively moving the print point leftwardly along the print line, means for accessing the print line memory means for reading selected locations of the ordered sequence, and after the operator has "space" moved the print point of the print means without printing to the right from previously printed character to locate the print point at least one position further to the right of the last printed character of the word which is to be erased, operation of the automatic word correcting system comprising the steps of:

a. providing a word erase actuating means and a word erase control means for operating the typewriter in word erase mode;

b. generating a word erase command signal responsive to operator actuation of said word erase actuating means;

c. conditioning said word erase control means to control operation of the word erase mode upon receipt of said word erase command signal;

d. operating the backspacing means for moving the print point of the print means leftwardly from the selected position of said word erase actuating mean through consecutive "space" positions to the first left printed character;

e. stopping the print point of the print means at the last left printed character of the unwanted word;

f. enabling the correction ribbon for erasing printed characters in correction mode;

g. operating the typewriter repeatedly in correction mode to progressively move the print point of the print means leftwardly from the last printed character through all consecutively printed characters while erasing each printed character when aligned opposite the print point; and h. stopping the leftwardly movement of the print point at the last erased position corresponding to the position vacated by the first character of the erased word.

9. The method of claim 8 wherein operation of said conditioning step (c.) further comprising the steps of:

c1. operating the accessing means to read the signal status in the ordered position of the print line memory means corresponding to the print point position of operator actuation of said word erase actuating means;

c2. accessing the print line memory means to read the next lower order position from the position read in step (c1.) responsive to reading therein of a "space" control signal corresponding to a previously entered "space" function;

c3. issuing a backspace control command to effect movement of the print point of the print means one character position to the left from the current print point position in response to step (c2.) reading a "space" control signal corresponding to a previously entered "space" function in the next left position.

10. The method of claim 9 wherein operation of said operating step (d.) is accomplished through repeating steps (c1.) (c2.) and (c3.) until in step (c3.) said backspace control command to effect stoppage of the print point in response to step (c2.) reading a character control signal corresponding to a previously printed character in the next left position.

11. A method of operating an automatic word correcting system in an electronic correcting typewriter having a keyboard containing character and function key actuating means for generating output signals representative of actuated keys, print line memory means for storing an ordered sequence of control signals representing a sequence of actuated keys including character control signals corresponding to operator actuated character keys and "space" control signals corresponding to operator actuated spacebar function key, print means including a print ribbon for printing a selected character at a print point on a recording medium and a correction ribbon for erasing previously printed characters, means for moving the print point of the print means along a print line of the recording medium including backspacing means for progressively moving the print point leftwardly along the print line, means for accessing the print line memory means for reading selected locations of the ordered sequence, and after the operator has typed a word and the print point of the print means is located at the last printed character of the word having a "space" control signal in the next right position operation of the automatic word correcting system to erase that word comprising the steps of:

a. providing a word erase actuating means and a word erase control means for operating the typewriter in word erase mode;

b. generating a word erase command signal responsive to operator actuation of said word erase actuating means;

c. conditioning said word erase control means to control operation of the word erase mode upon receipt of said word erase command signal;

d. operating the accessing means to read the signal status in the ordered position of the print line memory means corresponding to the print point position of operator actuation of said word erase actuating means;

e. accessing the print line memory means to read the next higher order position from position read in step (d) responsive to reading therein of a character control signal corresponding to a previously printed character;

f. enabling the correction ribbon for erasing printed characters in correction mode;

g. operating the typewriter repeatedly in correction mode to progressively move the print point of the print means leftwardly from the last printed character through all consecutively printed characters while erasing each printed character when aligned opposite the print point; and h. stopping the leftwardly movement of the print point at the last erased position corresponding to the position vacated by the first character of the erased word.

* * * * *

UNITED STATES PATENT AND TRADEMARK OFFICE

CERTIFICATE OF CORRECTION

PATENT NO. : 4,561,793

DATED : December 31, 1985

INVENTOR(S) : Raymond A. Blanchard, Jr.

It is certified that error appears in the above-identified patent and that said Letters Patent is hereby corrected as shown below:

Column 1, line 2,"WORK" should read -- WORD --.

Column 20, line 49, "last" should read -- first --.

Signed and Sealed this

Tenth Day of November, 1987

*Attest:*

DONALD J. QUIGG

*Attesting Officer*

*Commissioner of Patents and Trademarks*